US008510921B2

(12) United States Patent
Florea

(10) Patent No.: US 8,510,921 B2
(45) Date of Patent: Aug. 20, 2013

(54) DISPLAY FOR URN OR CASKET

(76) Inventor: Joshua Florea, Fruitport, MI (US)

( * ) Notice: Subject to any disclaimer, the term of this patent is extended or adjusted under 35 U.S.C. 154(b) by 0 days.

(21) Appl. No.: 13/269,359

(22) Filed: Oct. 7, 2011

(65) Prior Publication Data

US 2013/0086779 A1 Apr. 11, 2013

(51) Int. Cl.
*A61G 17/00* (2006.01)

(52) U.S. Cl.
USPC ..... 27/19; 27/1; 27/2; 40/725

(58) Field of Classification Search
USPC ..... 27/19, 10, 2, 1; 40/124.5, 725, 718, 40/739, 740, 790, 792–794; 312/114; 428/542.4; D99/4, 5, 8, 13
See application file for complete search history.

(56) References Cited

U.S. PATENT DOCUMENTS

| | | | | |
|---|---|---|---|---|
| 576,939 | A | 2/1897 | Baines | |
| D92,390 | S | 6/1934 | Cohen | |
| D93,349 | S | 9/1934 | King | |
| 4,324,026 | A | 4/1982 | Craft | 27/1 |
| 4,399,910 | A * | 8/1983 | Gutentag | 206/0.82 |
| 4,697,316 | A * | 10/1987 | Semon | 27/1 |
| 4,816,302 | A | 3/1989 | Shaw | |
| 5,533,241 | A | 7/1996 | McConnell | 27/27 |
| 5,704,103 | A | 1/1998 | Crowley et al. | 27/1 |
| 5,727,291 | A | 3/1998 | Biondo et al. | 27/2 |
| 5,729,921 | A | 3/1998 | Rojas | 40/124.5 |
| 5,813,099 | A * | 9/1998 | Stewart | 27/2 |
| 5,950,288 | A * | 9/1999 | Bach Lahor | 27/1 |
| 5,987,720 | A | 11/1999 | Yamamoto | 27/35 |
| D418,961 | S | 1/2000 | Biondo et al. | |
| D445,557 | S | 7/2001 | Chang | D99/5 |
| 6,519,886 | B1 * | 2/2003 | Johnson et al. | 40/790 |
| 6,526,636 | B2 | 3/2003 | Bernhardt | 27/1 |
| 6,543,103 | B1 | 4/2003 | Robert | |
| 6,557,222 | B2 | 5/2003 | Groemminger et al. | |
| 6,591,466 | B1 * | 7/2003 | Acton et al. | 27/10 |
| 6,691,385 | B2 | 2/2004 | Bell et al. | |
| 6,715,190 | B2 | 4/2004 | Groemminger et al. | |
| 6,722,001 | B2 | 4/2004 | Baker | |
| 6,836,936 | B1 | 1/2005 | Biondo et al. | 27/2 |
| 6,898,830 | B1 | 5/2005 | Acton et al. | 27/2 |
| 6,905,023 | B2 | 6/2005 | Au | |
| 7,082,653 | B1 | 8/2006 | Sueppel | 27/1 |
| 7,318,262 | B1 * | 1/2008 | Florea | 27/19 |
| 7,322,080 | B2 | 1/2008 | Parker et al. | |
| 7,562,423 | B2 * | 7/2009 | Pryd-Kakuk | 27/1 |
| 7,934,299 | B2 * | 5/2011 | Holzman | 27/27 |
| 8,196,275 | B2 * | 6/2012 | Wessel | 27/10 |
| 2004/0040130 | A1 | 3/2004 | Teague | 27/19 |
| 2010/0212124 | A1 * | 8/2010 | Denton et al. | 27/1 |

* cited by examiner

*Primary Examiner* — William L. Miller
(74) *Attorney, Agent, or Firm* — Waters & Associates PLC

(57) ABSTRACT

A cremation urn display has a floor, a top, and a perimeter sidewall. A viewable portion on the top or sidewall includes fasteners upon which a memorial display is surface mounted. The display includes a mounted butterfly fixed in a container having a viewable display panel. No recess need be formed in the top or sidewall to accommodate mounting of the display. The display is removable from the urn, and contains a sealable capsule for retaining a portion of cremated remains.

17 Claims, 7 Drawing Sheets

DISPLAY FOR URN OR CASKET

FIELD OF THE INVENTION

The invention relates to caskets and cremation urns generally, and more specifically to a unique symbolic enhancement that serves as a memorial to the casket or urn's occupant, as well as a structure and method for mounting the enhancement to a surface of the casket or urn.

BACKGROUND INFORMATION

When an individual passes away, it is customary to display the body of the individual in a casket at a funeral home, and thereafter the casket is buried. After the casket is buried, there is little left to remind the family of the burial ceremony.

In order to provide a lasting memorial of the funeral service, some caskets include nameplates or other keepsakes mounted on the side or in a recess in the casket, with the keepsakes sometimes being removable after the funeral service to be kept or displayed by the family. One example of this is disclosed in U.S. Pat. No. 7,318,262, issued to the inventor of the present application. A patent issued to McConnel, U.S. Pat. No. 5,533,241 disclosed a casket with a structure for mounting a picture on the exterior surface of the casket, where a frame would be fastened to the casket over the picture. McConnel teaches permanent fastening with bolts that extend through the side of the casket and secured with nuts that are on the interior of the casket.

Applications of these teachings have not lent themselves to being transferrable between a casket and an urn. Sometimes a deceased individual is displayed in a casket and is thereafter cremated. The family often desires to keep the cremains in an urn for a time, but any nameplate or keepsake that had been affixed to and removed from the casket could not be affixed to the urn for further display due to dimensional incompatibility.

What is needed is an affixable and removable keepsake that is readily transferrable from a casket to an urn.

After the family has buried or scattered the cremains, there may be a desire to keep some token amount of the cremains in the home as a comfort or reminder. Nameplates or keepsakes, as affixed and removed from caskets and/or urns, remain useful for display in the home, but do not provide storage for such a token amount of cremains.

What is needed is an affixable and removable keepsake that provides storage for a token amount of cremains.

SUMMARY OF THE INVENTION

One aspect of the present invention is to provide a removable display having ornamental and symbolic characteristics, and to provide a mounting mechanism therefor that is compatible with display on either a casket or an urn.

Another aspect of the invention is to incorporate the ornamental and symbolic display in an urn used to maintain the ashes of an individual who is cremated.

Yet another aspect of the invention is to incorporate storage for a token amount of ashes in the ornamental and symbolic display of an urn and/or casket.

Accordingly, a casket or urn embodied according to the invention includes a surface-mounted butterfly display that enhances the personalization of the funeral experience and serves as a symbolic reminder of the deceased.

According to one embodiment of the invention, a casket has a floor, a cooperating top that is spaced from the floor, and a perimeter sidewall extending between the floor and the top. A casket interior is defined between the floor, the top, and the sidewall, and an inner surface is adjacent the casket interior, while the outer surface faces away from the casket interior. A surface mount structure is disposed on the outer surface, without requirement for a recess in the sidewall. A display unit that corresponds to and is adapted to engage the surface mount structure is defined in the nature of a shadow box. The display unit has a transparent surface or panel that is placed in a position of being protruding from the outer surface. The display unit contains and displays a mounted butterfly, which serves as an attractive memorial that symbolizes the transition of the deceased individual to a higher form of life.

According to one embodiment of the invention, a funerary urn has a top and a perimeter sidewall extending downwardly from the top, with a removable bottom affixed inside the perimeter sidewall opposite the top. An urn interior is defined between the bottom, the top, and the sidewall, with an outer surface that faces away from the urn interior. A surface mount structure is disposed on the urn's outer surface, without requirement for a recess in the sidewall. A display unit that corresponds to and is adapted to engage the surface mount structure is defined in the nature of a shadow box. The display unit has a transparent surface or panel that is placed in a position of being protruding from the outer surface. The display unit contains and displays a mounted butterfly.

One way to embody the invention is for the display unit to have a retainer in the form of a frame that attaches to the sidewall or top of an urn or sidewall of a casket using a surface mount structure disposed on the sidewall or top of the exterior. The surface mount structure is embodied as two or more mechanical friction engagement fasteners, permanently affixed to the sidewall or top of an urn or sidewall of a casket, that align with corresponding voids on the back of the retainer frame. The retainer frame of the display unit fits about the edges of a display box that holds the display item (e.g., a butterfly) therein. The display box is held in a friction engagement within the retainer frame by a sponge foam gasket that exerts sufficient normal force upon the periphery of the display box to securely retain it within the display unit, while permitting the display box to be removed by application of manual shear pressure.

These and other features, objects, and benefits of the invention will be recognized by one having ordinary skill in the art and by those who practice the invention, from this disclosure, including the specification, the claims, and the drawing figures.

DETAILED DESCRIPTION

Figure 1:
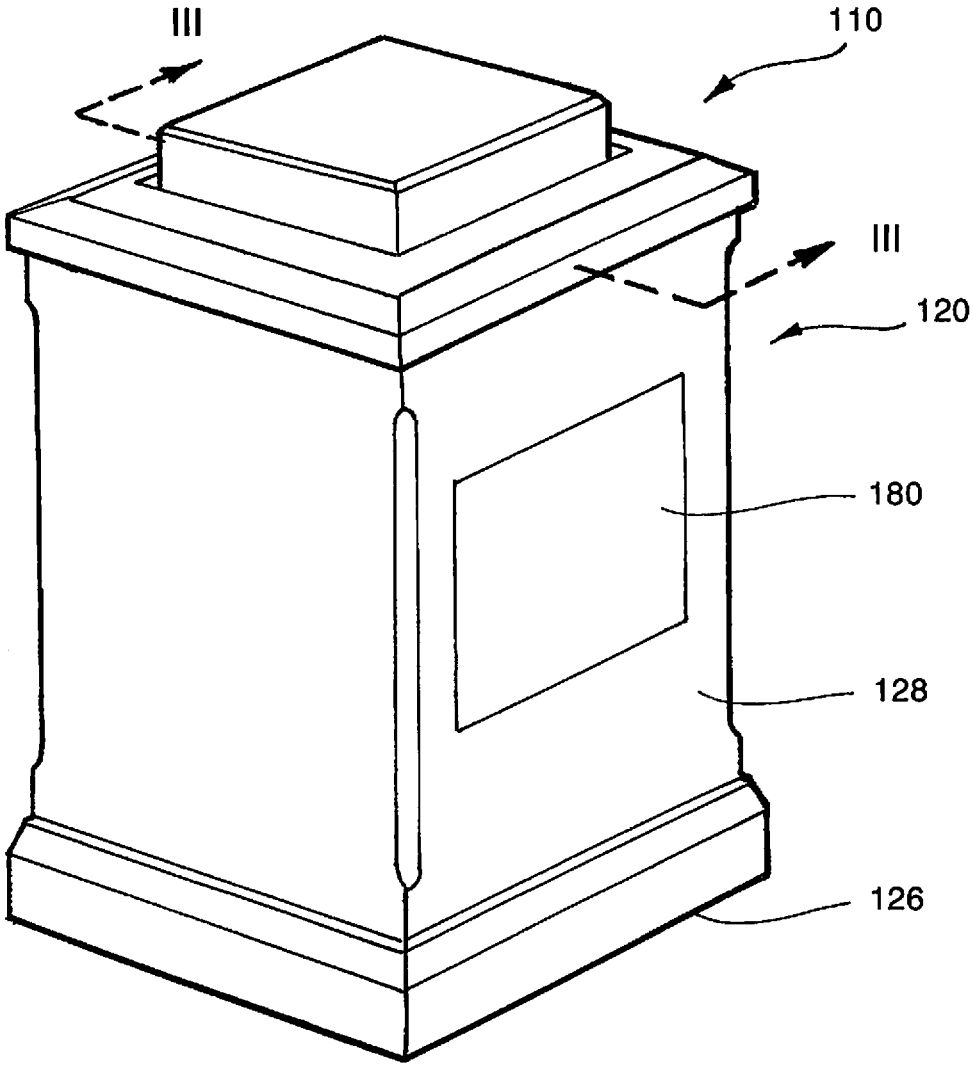
FIG. 1 is a perspective view of an urn according to one embodiment of the invention with a display removably fixed to the top of the urn.

A preferred embodiment of an urn/casket display according to the present invention is generally shown in the drawing figures and discussed below.

Referring to FIG. 1, an urn according to one embodiment of the invention is shown in perspective view. A display 110 is releasably secured to the top 122 (see FIG. 2) of the urn 120. A plaque 180 may be mounted on a side surface 128 of the urn 120. The urn 120 is manufactured with a form factor that lends itself to being displayed atop a mantle or shelf in the home. The urn 120 can be sized to accommodate the remains of a single person or two or more persons. As is common in the art, the bottom 126 of the urn 120 is removable for access to the interior of the urn where the ashes of the deceased would be placed in a secure container in the interior of the urn 120.

Figure 2:
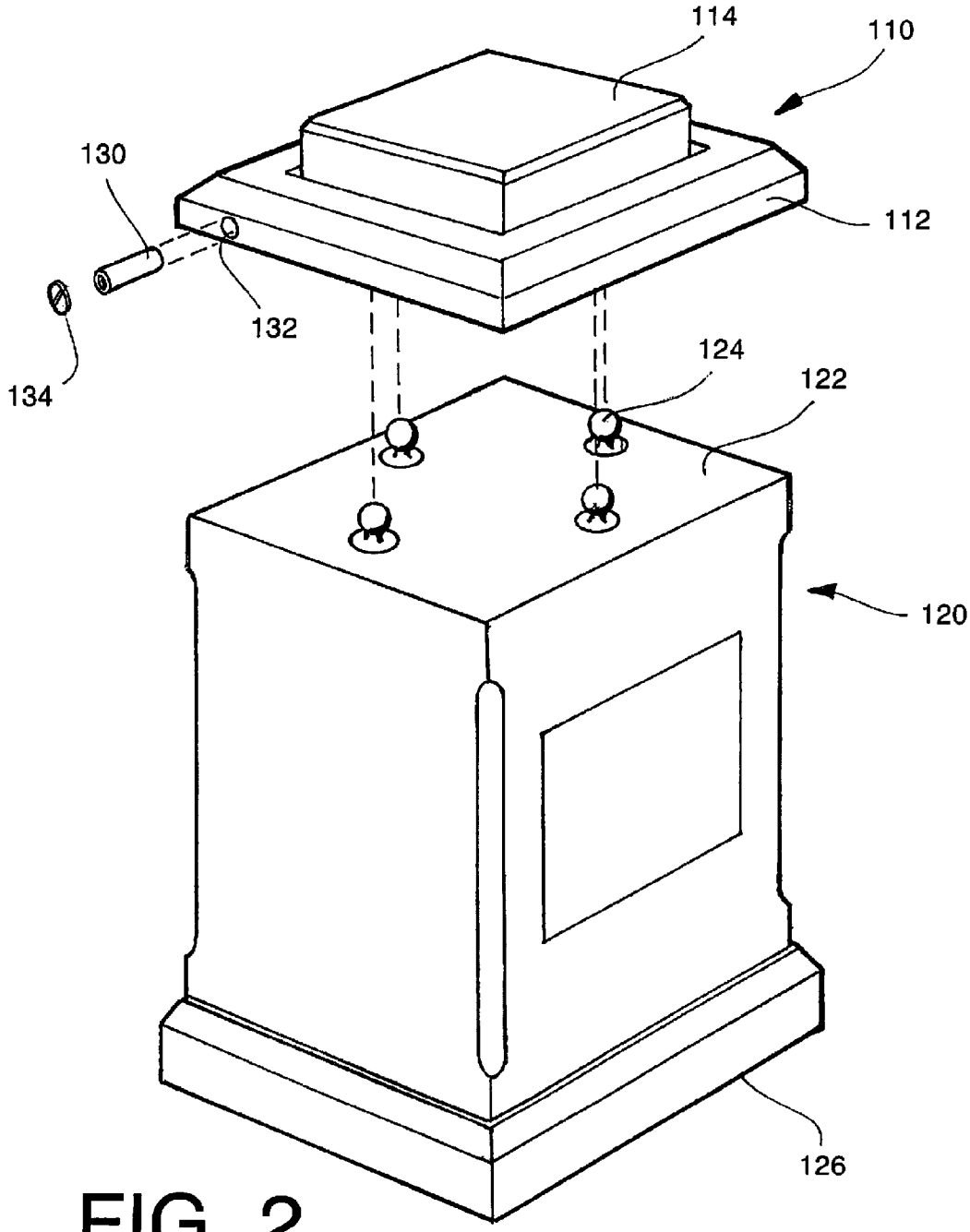
FIG. 2 is an exploded view of the embodiment of FIG. 1 with the display being removed from the urn top.

With reference to FIG. 2, where the urn of FIG. 1 is shown in an exploded view, the display 110 is shown removed from the top 122 of the urn 120. The display 110 has a display box 114 surrounded by a retainer frame 112 defining the periphery of the display 110. An item to be displayed is mounted inside the display box 114, which is nominally transparent. A borehole 132 is formed in the retainer frame 112 at a peripheral edge. A capsule 130 is sized to fit entirely inside the borehole 132 and is retained inside the borehole 132 by a friction fit or an adhesive. The capsule 130 is shown as have a cylindrical form, however the invention may be practiced with capsules of various shapes sized to fit within a cavity formed in the retainer frame 112. The cap 134 engages the outer end of the borehole 132 so as to securely cover and seal the capsule 130 inside the frame 112. The capsule 130 is sealed to contain a token portion of the decedent's cremated remains before being secured inside the borehole 132 with the cap 134.

While other methods of retaining the display 110 atop the urn 120 may be used, in this embodiment the display 110 is retained in a removable fixation at the top 122 of the urn 120 by plural friction engagement fasteners. The male ends 124 of the friction engagement fasteners project upwardly from the top 122 of the urn 120 and are aligned with corresponding female ends 324 (see FIG. 3) disposed in voids 322 formed into a back side 326 of the retainer frame 112. Other varieties of fasteners may be used to practice this aspect of the invention, such as spring fasteners.

In the event that an urn or casket having display fastener male ends 124 fitted is to be used without a display, a blank display may be employed, formed from a retainer frame having no central panel in lieu of the display box 114.

Figure 3:
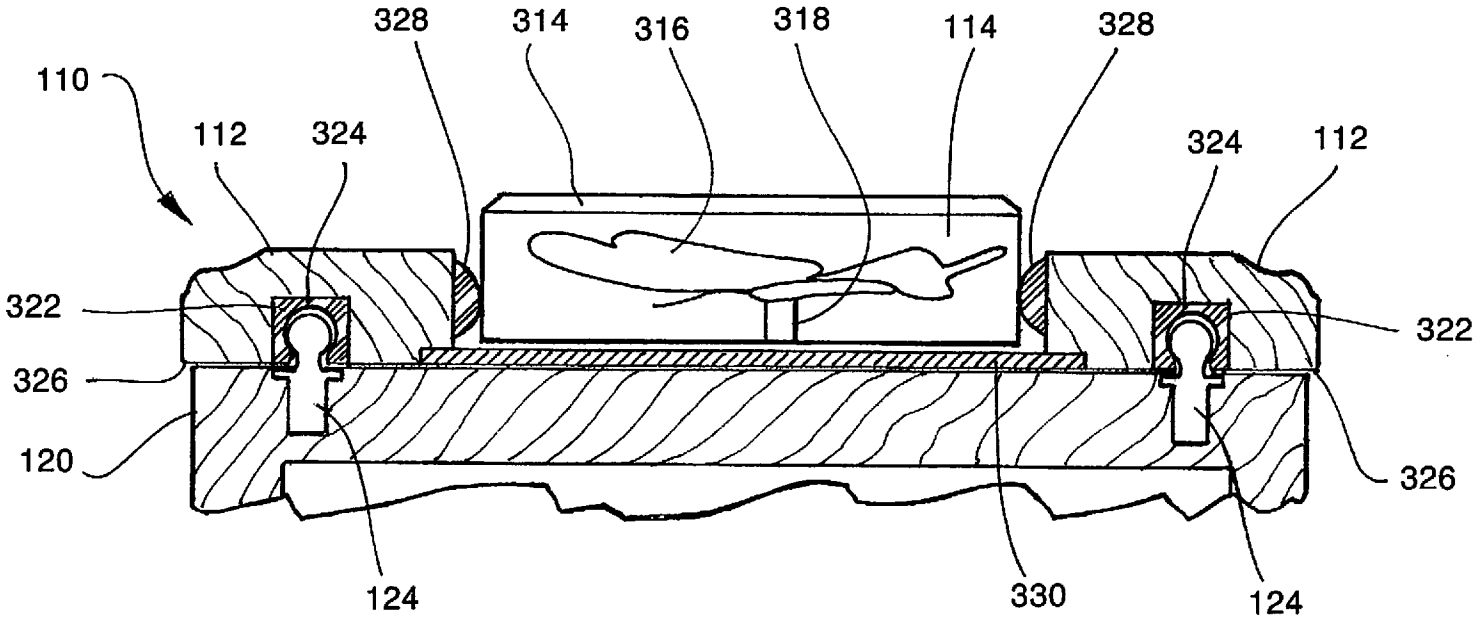
FIG. 3 is a fragmentary cross sectional view along line III-III of FIG. 1.

Making reference to FIG. 3, a fragmentary cross sectional view of the display 110, taken along section line III-III shown in FIG. 1, shows additional details of the display 110 structure. The display 110 is fixed to the top 122 (see FIG. 2) of the urn 120 by friction engagement fasteners. The male ends 124 of the friction engagement fasteners project upwardly from the top of the urn 120 and are shown fully engaged with corresponding female ends 324 disposed in voids 322 formed into the back side 326 of the retainer frame 112.

The display box 114 is a hollow closed container in which a butterfly 316 is mounted. The butterfly 316 desirably is a real butterfly that is preserved and mounted in the display box 114, which is advantageously embodied using a clear plastic box or case. The butterfly 316 may be mounted by itself or with other butterflies and may be positioned alone or with other materials in a natural setting. Butterfly boxes, as decoration, are commercially available. Whatever the butterfly display selected, the display box 114 is dimensioned appropriately to contain and display the objects inside it. A butterfly 316 may be secured in the box with a mount 318 that may extend to the butterfly from a perimeter of the display box. Thus, the display 110 is constructed with a transparent display panel 314 facing out from the retainer frame 112.

The display box 114 is retained within the retainer frame 112 by a friction engagement with a sponge foam gasket 328 disposed about the inner periphery of the retainer frame 112. The sponge foam gasket 328 and the retainer frame 112 exert sufficient normal force upon the periphery of the display box 114 to securely retain it within the display unit, while permitting the display box 114 to be removed by manual application of shear pressure. A back panel 330 is fastened to the back 326 of the retainer frame 112 and retains the display box 114 by impeding excessive travel through the retainer frame 112.

The use of a butterfly memorial is of particular significance. Since a butterfly represents a metamorphosis from one state of life, a caterpillar, to another and more beautiful state of life, a butterfly, the metamorphosis of a butterfly serves as a metaphor for the passing of an individual from life in this world to a more significant life in the next world. The display of a butterfly in a transparent box or shadow box thus signifies the transition through which the individual has passed, or will pass according to scriptural interpretation.

An urn typically is not buried but is maintained for display purposes. If maintained for display purposes, the butterfly display 110 typically would be mounted so that it remains in position atop the urn. A top mount is appropriate for display at a lower location where the top of the urn is viewable.

On the other hand, if the urn is not to be maintained for display purposes and is at any point to be buried, the butterfly display 110 would be retained because the butterfly display 110 is mounted in the urn in a removable manner. When the display 110 is removable from the urn 120 or casket before burial, the family may keep it to serve as a permanent memorial of the deceased. When removed, the display 110 can be displayed on a bookshelf, wall or other display location in the home of the family of the deceased. The butterfly display 110 can be labeled with an appropriate plaque or label that identifies the deceased and other pertinent information such as the date of birth and death.

Figure 4:
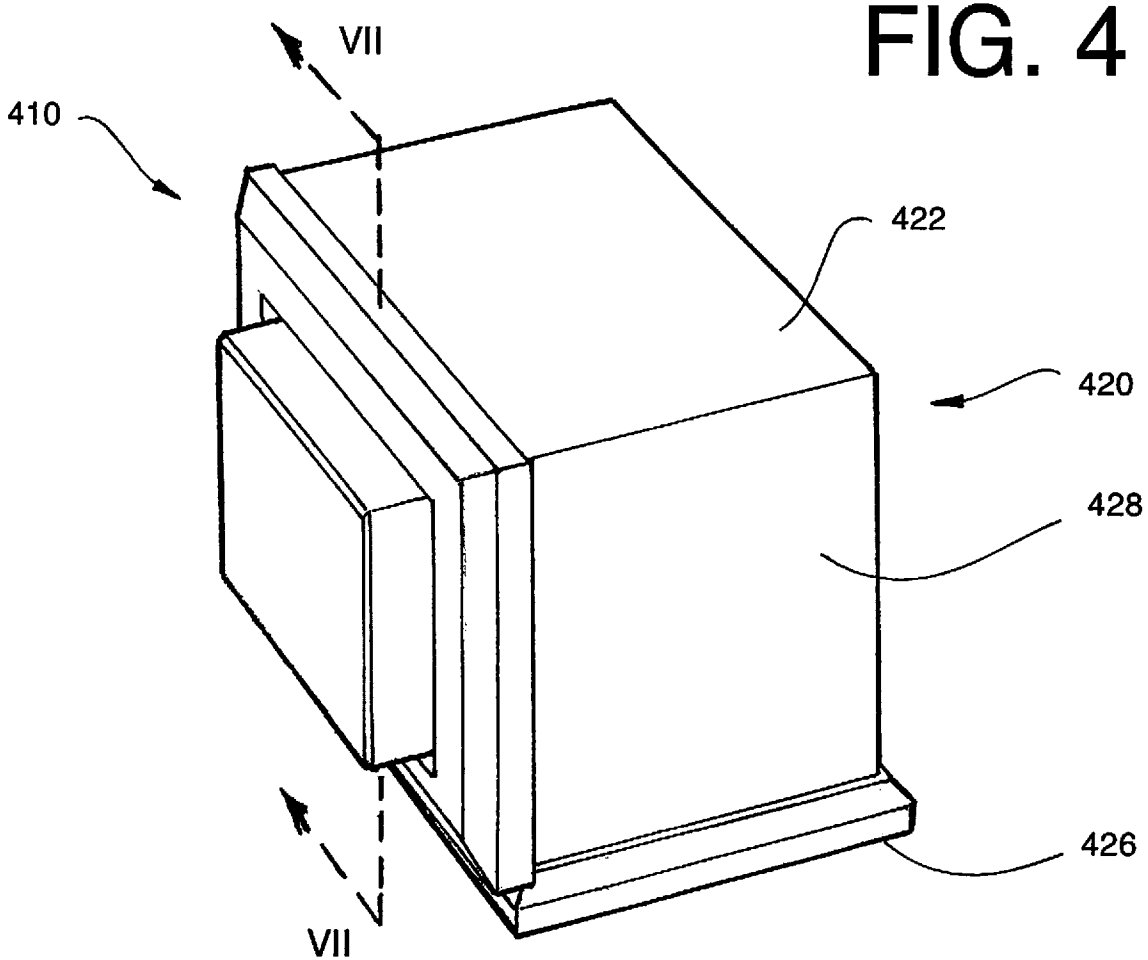
FIG. 4 is a perspective view of an urn according to another embodiment of the invention with a display removably fixed to a side of the urn.

FIG. 4 is a perspective view of an urn 420 according to another embodiment of the invention with a display 410 removably fixed to a side of the urn. The urn 420 has side surfaces 428 that extend between the top surface 422 and the bottom surface 426.

Figure 5:
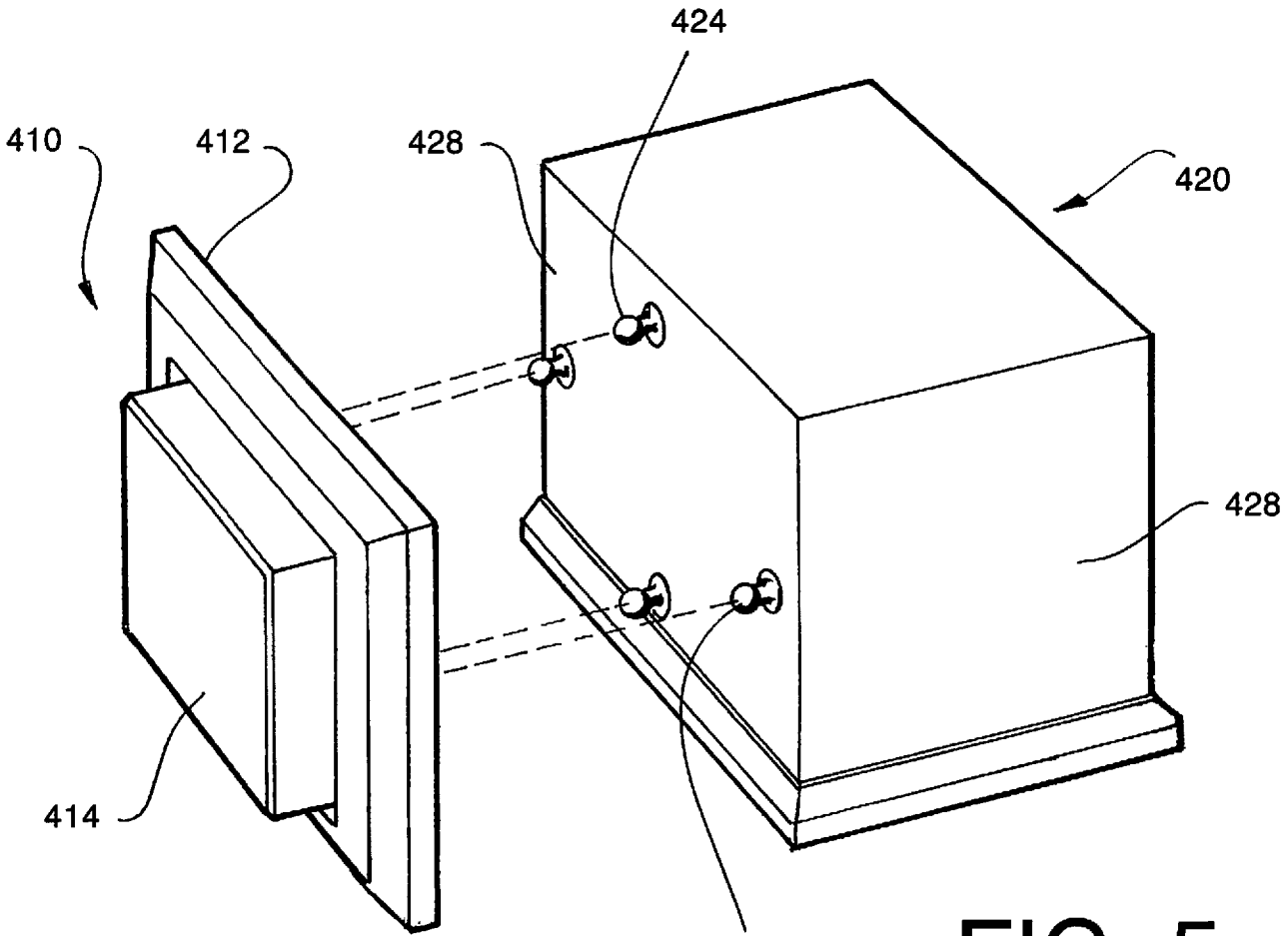
FIG. 5 is an exploded view of the embodiment of FIG. 4 with the display being removed from the side of the urn.

FIG. 5 is an exploded view of the embodiment of FIG. 4 with the display 410 being removed from the side 428 of the urn 420. The display 410 has a display box 414 surrounded by a retainer frame 412 defining the periphery of the display 410. An item to be displayed is mounted inside the display box 414, which is nominally transparent.

In this embodiment the display 410 is retained in a removable fixation at a side 428 of the urn 420 by plural friction engagement fasteners. The male ends 424 of the friction engagement fasteners project outwardly from the side 428 of the urn 420 and are aligned with corresponding female ends 724 (see FIG. 7) disposed in voids formed into a back side 726 of the retainer frame 412.

Figure 6:
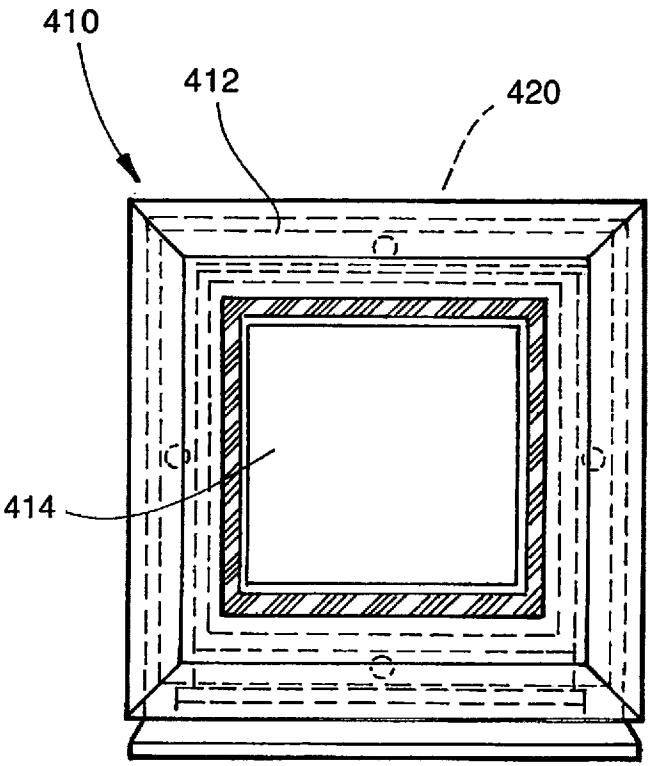
FIG. 6 is a side elevational view of the cremation urn of FIG. 4.

FIG. 6 is a side elevational view of the cremation urn of FIG. 4. The structure of the urn 420 is shown in phantom behind the display 410. This view faces the display 410, with the display box 414 surrounded by the retainer frame 412.

Figure 7:
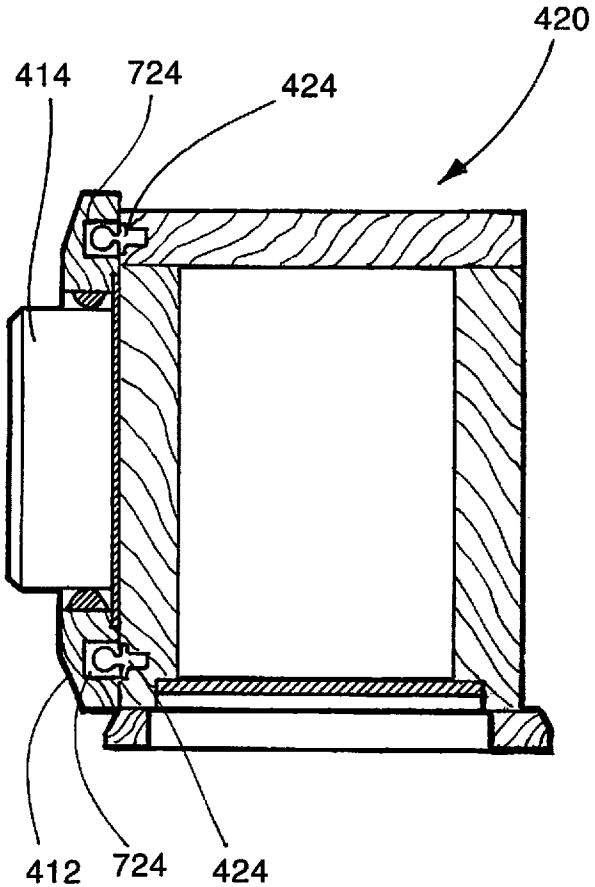
FIG. 7 is a cross sectional view along line VII-VII of FIG. 4.

FIG. 7 is a cross sectional view along line VII-VII of the cremation urn of FIG. 4. The display 410 is fixed to the side 428 (see FIG. 5) of the urn 420 by spring engagement fasteners. The male ends 424 of the spring engagement fasteners project outwardly from the side of the urn 420 and are shown fully engaged with corresponding female ends 724 disposed in the back side of the retainer frame 412. The display box 414 is encompassed by the retainer frame 412 and is retained in a frictional engagement within the retainer frame 412 in a similar manner as the corresponding structures described above with respect to FIGS. 1-3.

Figure 8:
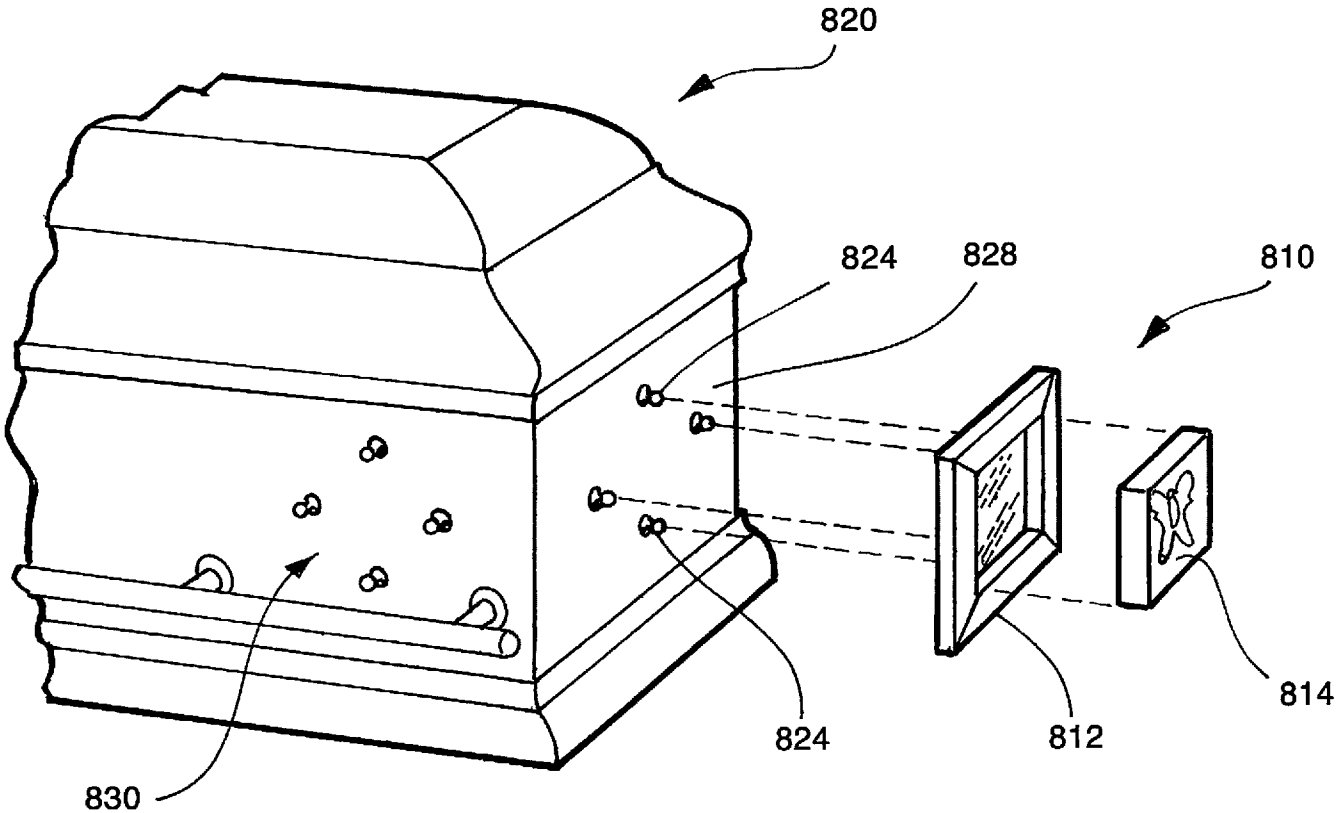
FIG. 8 is an exploded view of a casket according to another embodiment of the invention with a display shown in relative position for being removably fixed to a side of the casket.

FIG. 8 is an exploded view of a casket according to another embodiment of the invention with a display shown in relative position for being removably fixed to a side of the casket. As mentioned briefly above, the present invention may be embodied in the context of a display removably affixed to the exterior of a casket. The display 810 is shown removed from an endwall 828 of the casket 820. The display 810 has a display box 814 surrounded by a retainer frame 812 defining the periphery of the display 810. An item to be displayed is mounted inside the display box 814, which is nominally transparent.

As in the embodiments described above, the display 810 is retained in a removable fixation at the endwall 828 of the casket 820 by plural spring or friction engagement fasteners. The male ends 824 of the spring or friction engagement fasteners project outwardly from the endwall 828 of the casket 820 and are aligned with corresponding female ends disposed in a back side of the retainer frame 812 in a manner similar to that described above regarding other embodiments.

Practice of the present invention is not limited to only a single display being placed on the outside of a casket or urn. As an example, a second placement site 830 is shown on a side of the casket 820 for a further display to be fastened. The number of displays that may be implemented is limited only by practical considerations like available space on the exterior of the casket or urn.

In the exemplary embodiments described above, the urns have a rectangular solid geometry. It is noted that practice of the invention is not limited to such a form factor, and that displays according to the present invention may be practiced in the context of urns having other form factors and shapes. For example a circular or octagonal display may be implemented atop an upright cylindrical or quasi-cylindrical (i.e., fluted column) shaped urn.

Alternatively, the display includes a cast or molded shadow box that contains the display object. In this alternate embodiment, the display is formed as a geometric solid that is constructed of an appropriately transparent material in which the display object is embedded. The shadow box (or alternative display chamber) may have any desired configuration and is not limited to the rectangular solid geometry of the illustrated display chamber. Selection of the shadow box/display chamber configuration is advantageously made to facilitate arrangement in the display of various selected display objects to particular and personal effect, and to accommodate the geometries of different shapes of urns.

A memorial display for use with an urn or casket has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A display assembly for use with a funerary vessel having an exterior surface, the display assembly comprising:

a surface mount structure comprising two or more first-type fasteners adapted to be permanently affixed on the exterior surface; and a display unit comprising:

a retainer frame having an open interior;

two or more second-type fasteners permanently affixed to a surface of the retainer frame, each second-type fastener being configured and positioned to align with a corresponding one of the first-type fasteners affixed on the exterior surface, wherein interface of the first-type fasteners with the second type fasteners provides a mechanical engagement that attaches the display unit to the exterior surface and wherein the retainer frame is separate from the exterior surface and is free of any recess in the exterior surface;

a display box having a periphery that is encompassed in the open interior of the retainer frame;

a display item disposed inside the display box; and a resilient gasket disposed between the display box and the retainer frame wherein the display unit permits the display box to be removed without removal of the resilient gasket.

2. The display assembly of claim 1, wherein interface of the first-type fasteners with the second type fasteners provides a mechanical friction engagement that attaches the display unit to the exterior surface.

3. The display assembly of claim 1, wherein interface of the first-type fasteners with the second type fasteners provides a mechanical spring engagement that attaches the display unit to the exterior surface.

4. The display assembly of claim 1, wherein the resilient gasket retains the display box within the retainer frame via a friction engagement.

5. The display assembly of claim 4, wherein the friction engagement is provided by the resilient gasket through exertion of normal force between the periphery of the display box and the retainer frame, the normal force being sufficient to securely retain the display box within the display unit while permitting the display box to be removed by manual application of shear force.

6. The display assembly of claim 4, wherein the friction engagement is provided by the resilient gasket through exertion of normal force between the periphery of the display box and the retainer frame, the normal force being moderate enough to permit the display box to be removed by manual application of shear force.

7. The display assembly of claim 1, wherein the resilient gasket is formed of sponge foam.

8. The display assembly of claim 1, wherein the display box comprises a shadow box that provides the display unit with a transparent surface that is oriented to face away from the exterior surface.

9. The display assembly of claim 1, wherein the display item comprises a butterfly.

10. The display assembly of claim 1, wherein the funerary vessel comprises a casket or a funerary urn.

11. The display assembly of claim 1, wherein the retainer frame comprises a sealable capsule for retaining a portion of cremated remains.

12. The display assembly of claim 1, wherein the resilient gasket is permanently affixed to the retainer frame.

13. The display assembly of claim 1, wherein the gasket resiliently retains the display box in the retainer frame, such that the display box may be manually inserted in and removed from the frame.

14. A funerary display selectively attachable on non-recessed surfaces on a casket and urn, the funerary display comprising:

a display box having an inner side and exterior sides that enclose an open interior, at least one exterior side being at least partially transparent so as to display the interior of the box;

a display item mounted in the interior of the display box so as to be visible through the transparent exterior side;

a frame member separate from the casket and urn and display box, the frame member having peripheral sides and an open interior, with the peripheral sides having interior side edges, the interior side edges being formed to fit around the exterior sides of the display box;

a resiliently compressible display box retainer material positioned on the interior side edges of the frame, such that the retainer material engages the display box and is compressed between the frame and display box when the display box is positioned in the frame, the retainer material resiliently holding the display box in position in the frame when the display box is inserted in the frame, the retainer material permitting the display box to be manually mounted in and removed from the frame; and releasable mating friction engagement fasteners, each comprising mating fastener elements mounted on opposed, abutting surfaces of the frame member and the non-recessed surfaces on the casket and urn, the fasteners being constructed and positioned such that fastener elements on the frame can be slidably and releasibly engaged with mating fastener elements on the casket or urn to releasibly attach the frame member to the casket or urn, the display box thus being selectively and releasibly attachable first to a casket for funeral display and then being mountable on an urn after cremation and then being removable from the casket and urn for separate display.

15. A funerary display as in claim 14 wherein the fastener elements comprise first and second fastener elements, the first fastener element comprising a male element having an enlarged head and a shaft that extends from the head, with the shaft being imbedded in the casket or urn and the head extending therefrom, the second fastener element being attached in a void in the frame opposite to the first fastener element, the second fastener element comprising a recess that receives and releasibly holds the head of the first fastener element, the fastener elements being resiliently engagable by pressing the frame against the casket or urn with the first and second fastener elements in aligned engagement.

16. A funerary display removably attachable to a non-recessed mounting surface on a casket, the funerary display comprising:

a display box having an inner side and exterior sides that enclose an open interior, at least one exterior side being at least partially transparent so as to display the interior of the box;

a display item mounted in the interior of the display box so as to be visible through the transparent exterior side;

a frame member separate from the casket and display box, the frame member having peripheral sides and an open interior, with each peripheral side having an interior side edge, the interior side edges being formed to fit around the exterior sides of the display box;

a friction engagement display retainer positioned on interior side edges of the frame, such that the display retainer engages the display box and releasibly holds the display box in the frame when the display box is positioned in the frame and the frame is mounted on the non-recessed mounting surface of the casket; and releasable mating friction engagement fasteners, each comprising mating fastener elements mounted on opposed, mating surfaces of the frame member and the non-recessed mounting surface on the casket, the fasteners being constructed and positioned such that fastener elements on the frame can be slidably and releasibly engaged with mating fastener elements on the casket to releasibly attach the frame member to the casket, the display thus being selectively and releasibly attachable by the frame to the casket for funeral display and then being removable from the casket for retention and separate display after the casket is buried.

17. A funerary display as in claim 16, and further comprising an urn having a non-recessed mounting surface that mates with the display box and having fastener elements thereon that correspond to the fastener elements on the casket, such that the display box can be selectively mounted on the casket or urn.

* * * * *